US009297278B2

(12) United States Patent
Sanchez et al.

(10) Patent No.: US 9,297,278 B2
(45) Date of Patent: Mar. 29, 2016

(54) VARIABLE FEEDWATER HEATER CYCLE

(75) Inventors: Nestor Hernandez Sanchez, Schenectady, NY (US); Richard Eugene Kehl, Niskayuna, NY (US); Kamlesh Mundra, Clifton Park, NY (US); James Michael Stagnitti, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 366 days.

(21) Appl. No.: 13/117,492

(22) Filed: May 27, 2011

(65) Prior Publication Data

US 2012/0297771 A1 Nov. 29, 2012

(51) Int. Cl.

*F01K 7/34* (2006.01)
*F01K 7/22* (2006.01)
*F01K 7/40* (2006.01)

(52) U.S. Cl.

CPC .... *F01K 7/22* (2013.01); *F01K 7/40* (2013.01)

(58) Field of Classification Search

USPC ..... 60/676, 662
See application file for complete search history.

(56) References Cited

U.S. PATENT DOCUMENTS 3,488,961 A * 1/1970 Gerber ..... F01K 7/24 237/12.1
3,826,093 A * 7/1974 Miliaras ..... F01K 7/22 60/662
3,842,605 A * 10/1974 Tegtmeyer ..... F01K 7/22 60/678
4,043,130 A * 8/1977 Brown ..... F01K 7/223 60/652
4,069,674 A * 1/1978 Warren ..... 60/641.8
4,343,682 A * 8/1982 Grimes ..... G21D 1/02 376/214
4,352,270 A * 10/1982 Silvestri, Jr. ..... F01K 3/002 60/648
4,403,476 A * 9/1983 Johnson ..... F01D 17/105 60/652
4,471,618 A * 9/1984 Tratz ..... F22D 11/06 376/315
4,686,832 A * 8/1987 Miliaras ..... 60/676
4,888,953 A * 12/1989 Fukayama et al. ..... 60/657
4,976,100 A * 12/1990 Lee ..... 60/772
5,404,724 A * 4/1995 Silvestri, Jr. ..... 60/678
5,464,318 A * 11/1995 Eklund ..... F01K 7/345 415/20
8,337,139 B2 * 12/2012 Sanchez ..... F02C 6/04 415/1
2009/0208402 A1 8/2009 Rossi
2009/0260359 A1 * 10/2009 Palkes ..... F01K 3/06 60/641.8
2011/0283704 A1 * 11/2011 Hatamiya ..... F01K 7/38 60/670

FOREIGN PATENT DOCUMENTS

EP 0395363 A2 10/1990
EP 0643816 B2 10/2003
EP 2015312 A2 1/2009
EP 2180252 A1 4/2010
JP 11347332 A2 12/1999
WO WO2009129166 A2 * 10/2009

* cited by examiner

*Primary Examiner* — Jorge Pereiro
*Assistant Examiner* — Shafiq Mian
(74) *Attorney, Agent, or Firm* — Ernest G. Cusick; Hoffman Warnick LLC

(57) ABSTRACT

A structure, system, and method for controlling a power output and flue gas temperature of a power plant by adjusting final feedwater temperature are disclosed herein. In an embodiment, a turbine having a plurality of valved steam extraction ports is provided. Each steam extraction port is fluidly connected with a feedwater heater. Each of the plurality of valves in the valved steam extraction ports may be opened and closed to the passage of steam therethrough, in order to vary a final feedwater temperature.

19 Claims, 4 Drawing Sheets

VARIABLE FEEDWATER HEATER CYCLE

BACKGROUND OF THE INVENTION

The invention relates generally to a feedwater heater cycle for a power plant. More particularly, the invention relates to a variable feedwater heater cycle allowing for active control of final feedwater temperature for optimal efficiency at a variety of operating conditions.

In power plants, the power output, temperature of exhausted flue gas, and efficiency are heavily impacted by adjusting a temperature of the feedwater system, i.e., the final feedwater temperature (FFWT), that enters the steam generating element, for example, a boiler in the plant. Where boilers are configured to accommodate combustion of different types of fuels, and/or operation at different loads, each set of operational conditions may require a unique final feedwater temperature (FFWT) in order to achieve maximum efficiency.

BRIEF DESCRIPTION OF THE INVENTION

A first aspect of the disclosure provides a structure comprising a turbine having a plurality of valved steam extraction ports fluidly connected to a steam extraction line for delivering steam to a feedwater heater.

A second aspect of the disclosure provides a system for controlling a power output of a power plant, comprising a variable feedwater heating system including: a turbine having a plurality of valved steam extraction ports fluidly connected to a steam extraction line for delivering steam to a feedwater heater; a control system for opening and closing each valve of the plurality of valved steam extraction ports in response to a desired final feedwater temperature; and a steam generator in circuitous fluid connection with the variable feedwater heating system.

A third aspect of the disclosure provides a method for optimizing a final feedwater temperature comprising: providing a variable feedwater heating system including: a turbine having a plurality of valved steam extraction ports fluidly connected to a feedwater heater; and actively controlling an opening and a closing of each valve of the plurality of valved steam extraction ports in response to a desired final feedwater temperature.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

At least one embodiment of the present invention is described below in reference to its application in connection with the operation of a power plant. Although embodiments of the invention are illustrated relative to a power plant including a boiler and a steam turbine, it is understood that the teachings are equally applicable to other types of power plants including, but not limited to, geothermal energy or solar energy plants, fossil fuel plants, biomass-fueled plants, combined cycle plants, nuclear plants and other types of power plants. Further, at least one embodiment of the present invention is described below in reference to a nominal size and including a set of nominal dimensions. However, it should be apparent to those skilled in the art that the present invention is likewise applicable to any suitable power plant. Further, it should be apparent to those skilled in the art that the present invention is likewise applicable to various scales of the nominal size and/or nominal dimensions.

Figure 1:
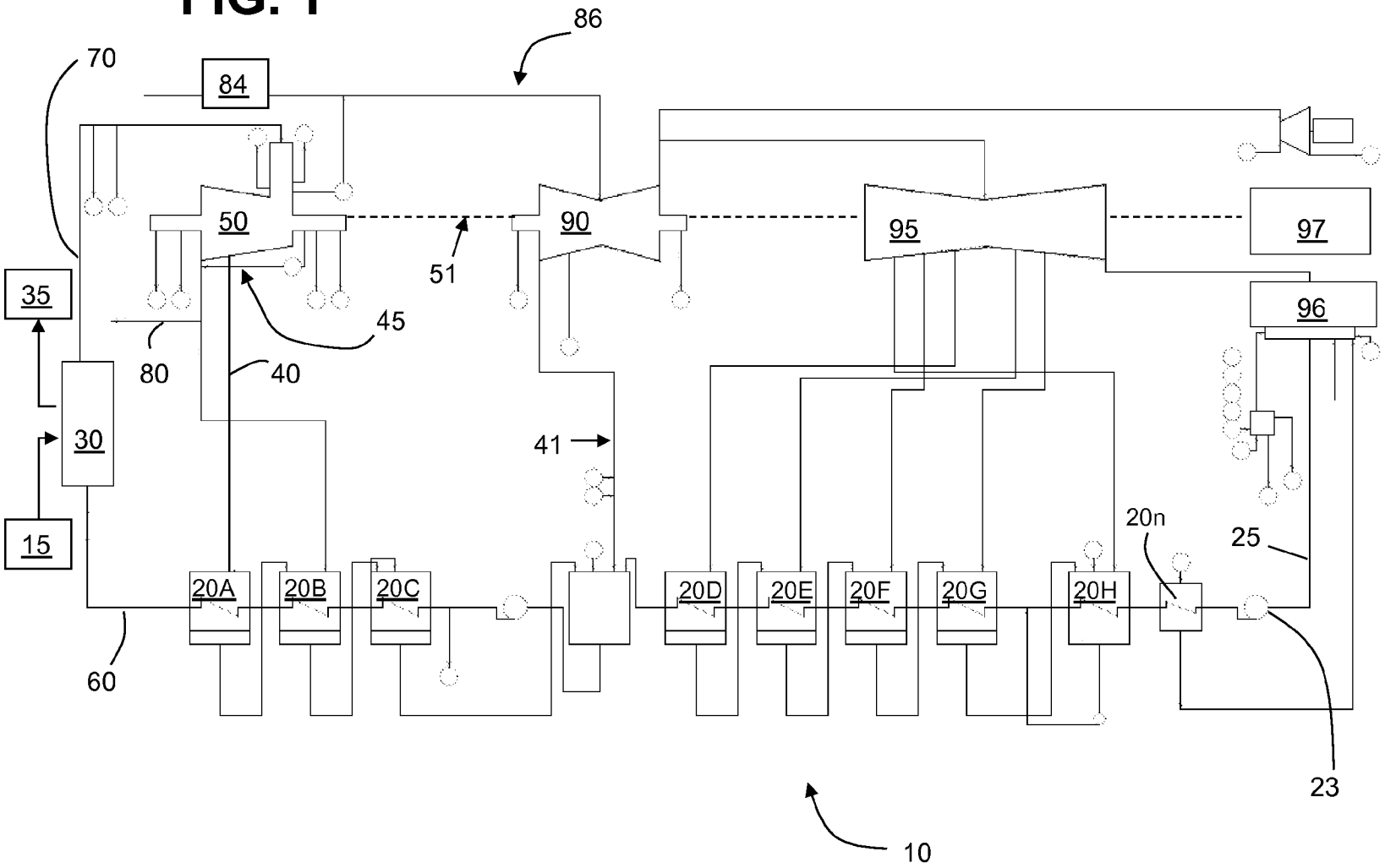
FIG. 1 shows a schematic drawing of a steam turbine cycle having a single final feedwater extraction port.

As indicated above, aspects of the invention provide a feedwater heater cycle structure. Referring to FIG. 1, a general schematic of a power plant 10 is provided. Power plant 10 includes at least one feedwater heater 20A, and may include a plurality of feedwater heaters 20A, B . . . n as shown in FIG. 1. In other embodiments, greater or fewer than three feedwater heaters 20A-20*n* may be used.

Feedwater heaters 20A-20*n* receive feedwater supplied by feedwater pump 23 via feedwater input line 25. It is noted that additional pumps may be present throughout the system to achieve and maintain the required maximum operating pressure.

As shown in FIG. 1, feedwater heater 20A receives high pressure, high temperature steam from high pressure (HP) steam turbine 50 via steam extraction line 40. Steam extraction line 40 is fluidly connected with HP steam turbine 50 at feedwater extraction port 45, located between stages of HP steam turbine 50. A portion, referred to as the extraction fraction, of the total cycle steam mass flow used to generate HP power in the steam turbine 50, is fed to feedwater heater 20A. The extraction fraction must be optimized for maximum thermal efficiency of power plant 10, since an increase in the extraction fraction results in decreased power output.

The extraction fraction of steam from HP turbine 50 is routed to at least one of feedwater heaters 20A-20*n* (in FIG. 1, to feedwater heater 20A) and circulated therethrough to heat the feedwater flowing through feedwater heaters 20A-20*n* to a predetermined final feedwater temperature (FFWT). The FFWT is a system parameter that may vary with a type of fuel 15 used to power steam generator 30. Once heated to the FFWT, the feedwater is then fed from feedwater heaters 20A-C via line 60 to steam generator 30, which may use any of a number of heat sources.

Steam generator 30 may, in some embodiments, be a boiler which burns fossil fuels, biomass, or other fuels 15 in order to generate steam. In other embodiments, steam generator 30 may be a heat exchanger, as in a nuclear power plant, a geothermal energy source in a geothermal plant, waste heat, as in a combined cycle plant or other suitable steam source. In any event, steam is produced in steam generator 30, following which steam generator 30 releases high temperature steam via output steam line 70, and expels flue gas 35.

Output steam line 70 feeds high pressure, high temperature steam into the high pressure turbine 50, where the steam is used to generate power in high pressure turbine 50, which drives a shaft 51 to rotate a rotor within a stationary stator in generator 97. Subsequently, exhaust line 80 may feed steam into reheater 84 (in a case of a reheat cycle) or directly into the intermediate pressure turbine 90 through line 86 to generate intermediate pressure (IP) output. An extraction fraction is directed back to feedwater heater 20A as described above via steam extraction line 40. Similarly, steam used to generate power in IP turbine 90 is fed into low pressure (LP) turbine 95, less an extraction fraction which may be fed back into the feedwater heater cycle via second steam extraction line 41. In some embodiments, there may be more than one feedwater extraction in IP steam turbine 90 as described above relative to HP turbine 50. After passing through low pressure steam turbine 95, the steam is condensed in condenser 96 and recycled through the feedwater heater cycle via feedwater pump 23 and feedwater input line 25.

As discussed above, the final feedwater temperature is a parameter of operation of power plant 10 that ideally varies according to the type of fuel used to power steam generator 30 and power plant load requirements. FFWT has significant impact on performance of steam generator 30. Tailoring the FFWT according to the fuel source being used allows steam generator 30, and therefore plant 10, to operate at optimal efficiency. Similarly, tailoring the FFWT to accommodate part load operation also allows for improved efficiency.

Figure 2:
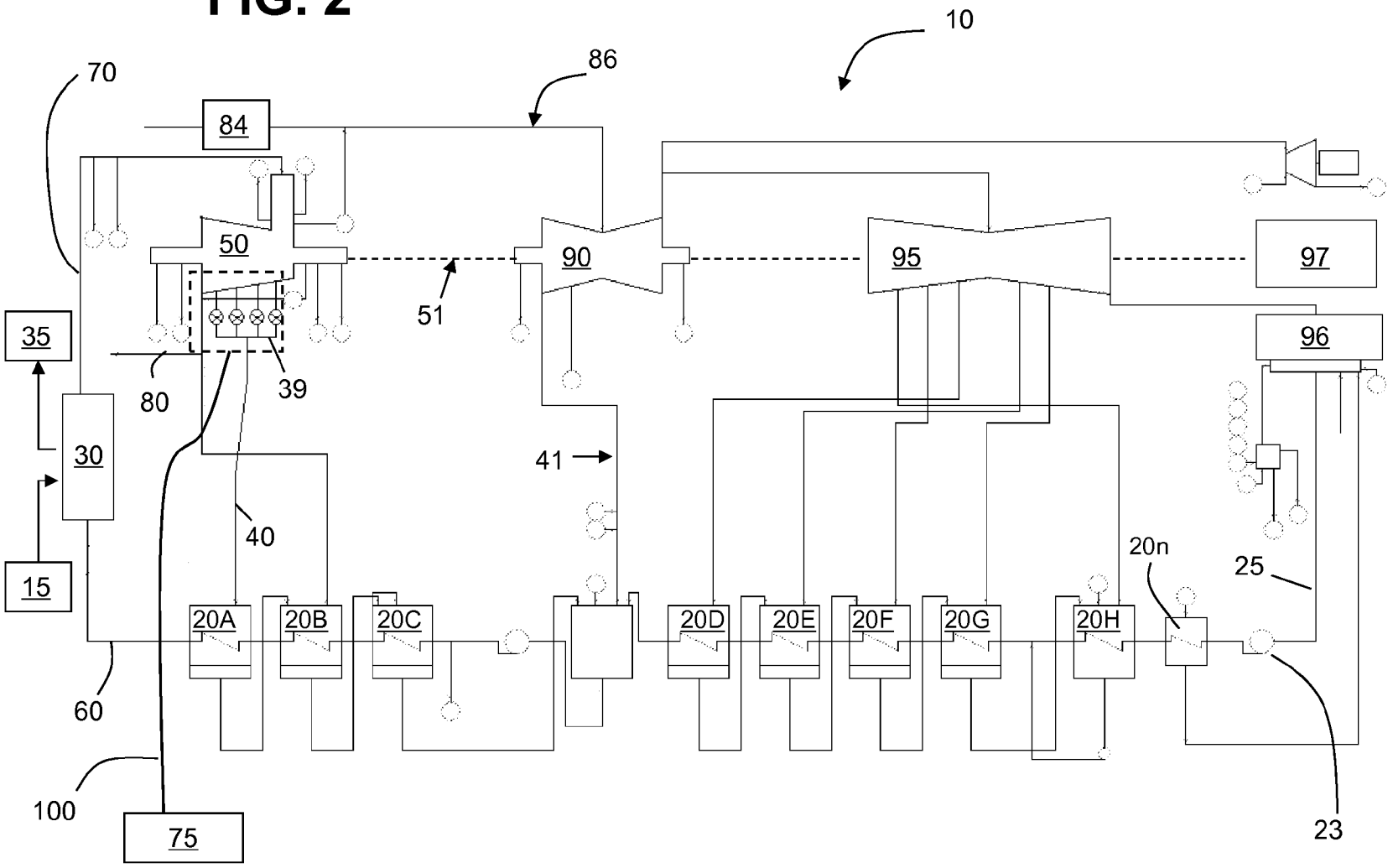
FIG. 2 shows a schematic drawing of a steam turbine cycle having a plurality of final feedwater extraction ports in accordance with an embodiment of the invention.

As shown in FIG. 2, a structure is provided which facilitates optimization of the FFWT for use, e.g., with a multi-fuel steam generator 30. Steam generator 30 may use any one or more fuels 15 including fossil fuels, e.g., petroleum, coal, or natural gas; oxygen; air; biomass; or may be substituted by a nuclear reactor, or a geothermal energy or solar energy source, although the structure may also work with single-fuel steam generators. Characteristics of each energy source may result in a unique optimal FFWT for each fuel type.

Figure 3:
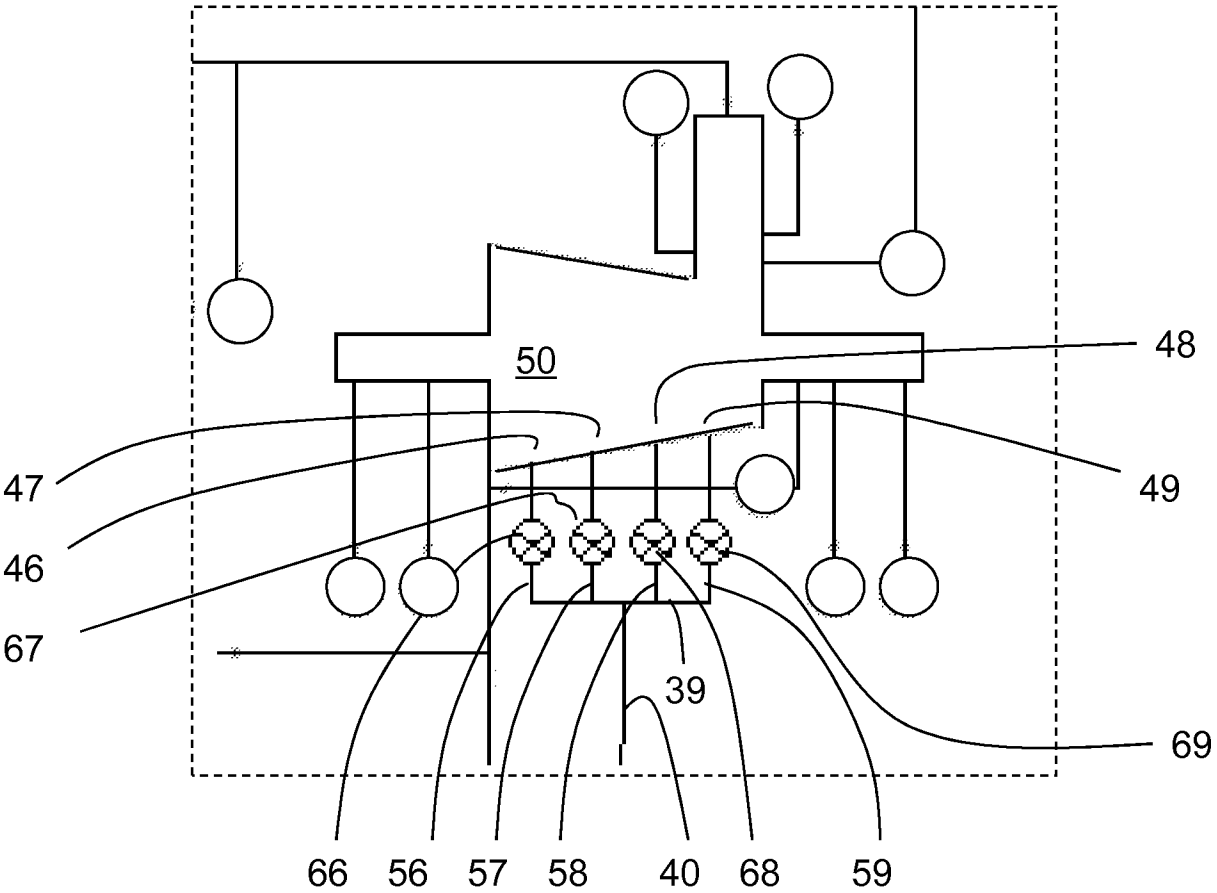
FIG. 3 shows a detailed view of the plurality of final feedwater extraction ports of FIG. 2.

In order to vary a FFWT, HP steam turbine 50 may be provided with a plurality of steam extraction ports, or feedwater extraction ports. FIGS. 2-3 depict one possible embodiment including first, second, third, and fourth feedwater extraction ports 46, 47, 48, 49 (labeled in FIG. 3). This embodiment is not intended to be limiting, however, as other arrangements and numbers of feedwater extraction ports may be used. In other embodiments, as few as two and as many as seven feedwater extraction ports may be used.

A plurality of pipes 56, 57, 58, 59 (labeled in FIG. 3) are provided. Each pipe is fluidly connected at a first end thereof to one of the plurality of steam extraction ports 46, 47, 48, 49. A plurality of valves 66, 67, 68, 69 are disposed such that each of the plurality of pipes 56, 57, 58, 59 includes a valve 66, 67, 68, 69 for opening and closing the respective pipe 56, 57, 58, 59 to steam. Each of the plurality of pipes 56, 57, 58, 59 is fluidly connected at a second end thereof to a single line 39, fluidly connecting each of the plurality of pipes 56, 57, 58, 59 to steam extraction line 40 for delivering steam to a feedwater heater, e.g., 20A (FIG. 2).

Figure 4:
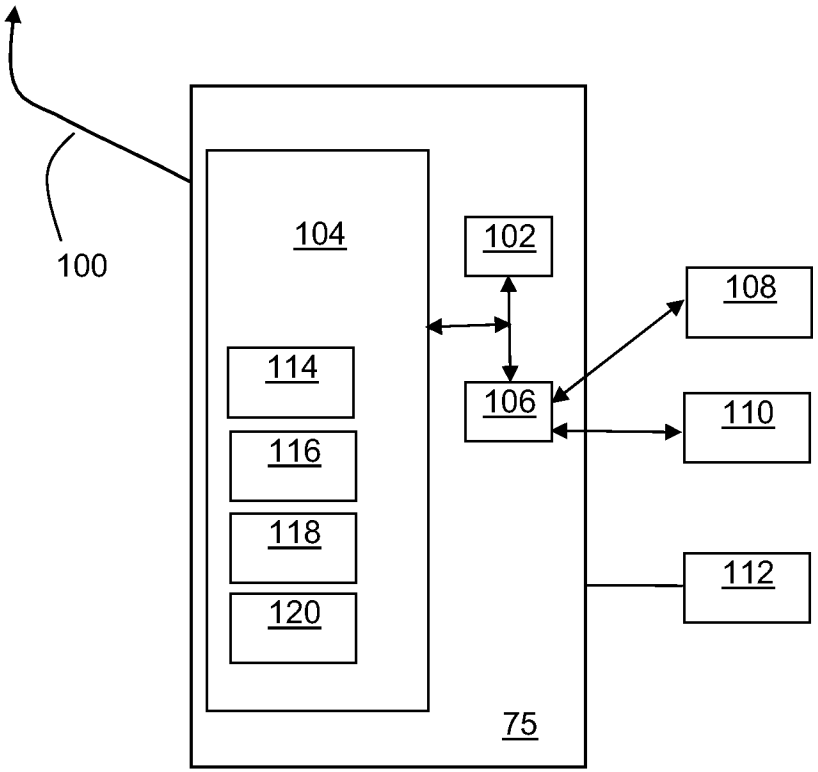
FIG. 4 shows a schematic depiction of the control system shown in FIG. 2, in accordance with embodiments of the invention.

The opening and closing of valves 66, 67, 68, 69 may be controlled by control system 75, in response to a desired final feedwater temperature. Control system 75 is shown in greater detail in FIG. 4, in which valves 66, 67, 68, 69 are linked via coupler 100 to control system 75.

As shown, control system 75 includes a processor 102, a memory 104, and input/output (I/O) interfaces 106 operably connected to one another. Further, control system 75 is shown in communication with display 108, external I/O devices/resources 110, and storage unit 112. I/O devices 110 may include any type of user input device such as a mouse, keyboard, joystick, or other selection device. In general, processor 102 executes computer program code which provides the functions of control system 75. Such program code may be in the form of modules, including fuel module 114, load module 116, ambient conditions module 118, and system degradation module 120, among other possible modules, and may be stored in memory 104 and/or storage unit 112, and perform the functions and/or steps of the present invention as described herein. Memory 104 and/or storage unit 112 can comprise any combination of various types of data storage media that reside at one or more physical locations. To this extent, storage unit 112 could include one or more storage devices, such as a magnetic disk drive or an optical disk drive. Still further, it is understood that one or more additional components not shown in FIG. 4 can be included in control system 75. Additionally, in some embodiments one or more external devices 110, display 108, and/or storage unit 112 could be contained within control system 75, not externally as shown.

As noted, control system 75 may include one or more of a fuel module 114 for analyzing an input type of fuel 15, a load module 116 for analyzing a load at which the turbine is operating, typically in megawatts, an ambient conditions module 118, for analyzing ambient conditions in HP turbine 50 as may be detected by a sensor or sensors in the plant (not pictured), and a system degradation module 120 for analyzing any degradation to the system which may impact efficiency, performance and/or other aspects of operation over the lifespan of various components. Other modules for analyzing other system parameters are also contemplated, and may also be included.

Separately or collectively, modules 114, 116, 118, and 120 may include an algorithm for mapping operating conditions, including fuel, load, ambient conditions (e.g., temperature), and degree of degradation, to a particular steam extraction port 46, 47, 48, 49. In one embodiment, this logic may be embedded into each of the modules 114, 116, 118, 120. In another embodiment, this logic may reside in memory 104 on control system 75, which receives data from a variety of sources which may include, e.g. sensors in plant 10, operator input, etc. The particular steam extraction port 46, 47, 48, 49 to which conditions are mapped is the port which, when the respective valve 66, 67, 69, 69 is opened, an optimum FFWT is provided. Following the determination of which valve 66, 67, 68, 69 must be opened to achieve the optimum FFWT, a signal is transmitted via coupler 100, causing the opening (or closing) of the appropriate valve 66, 67, 68, 69. Following determination and execution of opening and/or closing the appropriate valve 66, 67, 68, 69, data may be archived, reported, and stored in memory 104 and/or in storage unit 112. In various embodiments, modules 114, 116, 118, 120 may be part of a standalone control system 75, or may be integrated with any other plant control system which may be used.

Returning to FIG. 3, in some embodiments, valves 66, 67, 68, 69 may be opened in the alternative, i.e., one valve at a time. Each pipe 56, 57, 58, 59 may have different design parameters such as flow capacity or routing, allowing a different volume of steam to pass therethrough. Feedwater heater 20A is therefore heated to optimal operating conditions by conducting an appropriate extraction pressure of steam to feedwater heater 20A.

As shown in FIG. 2, steam passes from steam extraction line 40, feedwater heater(s) 20A-20*n*, and line 60 to steam generator 30. As noted above, in various embodiments, steam generator 30 may be one or more of: a multi-fuel boiler, a biomass fueled boiler, a fossil fueled boiler, an oxygen combustion boiler, an air combustion boiler, a nuclear reactor, a geothermal energy source, and a solar energy source. Depending on the energy source or fuel type 15 as well as operating plant load for steam generator 30, a different final feedwater temperature may be necessary to achieve the greatest efficiency in steam generator 30 and therefore power plant 10. The desired temperature may be achieved by varying the extraction location of steam conducted to feedwater heater(s) 20A-20*n*.

In addition to affecting efficiency of steam generator 30, the final feedwater temperature also impacts the temperature of flue gas 35 exhausted from power plant 10. Control of the temperature of flue gas 35 is important because of the chemicals present in flue gas 35 from the combustion process, particularly sulfur. Flue gas 35 must have a high enough temperature to prevent sulfuric acid condensation in the flue gas 35 pipes, to avoid corrosion damage. However, an unnecessarily high temperature of flue gas 35 results in dissipating energy to the atmosphere, which could be used to generate more steam. Balancing the objectives of avoiding corrosion and maximizing efficiency requires delicate balance, which is affected by the use of different fuels 15 and operation at part load conditions break that balance. These factors are included in those accounted for in control system 75.

As discussed above, steam is also returned to HP turbine 50 such that steam generator 30 is in circuitous fluid connection with the variable feedwater heating system, i.e., the steam flows fluidly through the cycle.

In addition to accommodating a variety of fuel 15 sources as detailed above, the use of a plurality of feedwater extraction ports 46, 47, 48, 49 as described above further allows for optimization of FFWT in accordance with turbine load in order to maximize efficiency for the given load condition. An optimized final feedwater temperature may be determined substantially in accordance with the function, $$FFWT=T_{sat}(P)$$

where

FFWT=final feedwater temperature;

$T_{sat}$=saturation temperature of the steam at the extraction port pressure; and P=extraction port pressure in feedwater heater 20A.

For example, where the load is about 50% of full load (i.e. maximum capacity), pressure drops by 50% compared to pressure under full load conditions, and the FFWT is decreased as well. But valves 66, 67, 68, 69 can be adjusted according to the above function in order to achieve maximum efficiency and flue gas 35 control at these operating conditions.

In the embodiment shown in FIG. 2, only feedwater heater 20A, i.e. the top feedwater heater in the system, is depicted as receiving variable input via steam extraction line 40. However, in other embodiments not pictured merely for ease of explanation, feedwater heaters 20B-20*n* may also receive variable input in the same manner.

Also provided is a method for optimizing a final feedwater temperature. A variable feedwater heating system is provided, which includes a high pressure turbine 50 having a plurality of steam extraction ports 46, 47, 48, 49, with a plurality of pipes 56, 57, 58, 59 connecting each of the steam extraction ports 46, 47, 48, 49 with single line 39 to steam extraction line 40. Each of the plurality of pipes 56, 57, 58, 59 includes a valve 66, 67, 68, 69 disposed therein for opening and closing the respective pipe 56, 57, 58, 59 to the passage of steam. Single line 39 thereby fluidly connects the second end of each of the plurality of pipes 56, 57, 58, 59 with steam extraction line 40 to a feedwater heater 20A-C. In response to a desired final feedwater temperature, the opening and closing of valves 66, 67, 68, 69 is actively controlled via control system 75. As described above, control system 75 allows an appropriate extraction pressure of steam to be conducted to feedwater heaters 20A . . . *n* to achieve maximum efficiency and/or control flue gas 35 temperature.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A structure comprising:

a variable feedwater heating system including:

a turbine having a plurality of steam extraction ports;

a plurality of pipes, wherein each pipe has a first end, a valve, and a second end, the first end of each pipe being fluidly connected to a respective plurality of steam extraction ports, wherein the second end of each of the plurality of pipes is connected in parallel to a single line;

a steam extraction line having a first end and a second end, the first end of the steam extraction line being fluidly connected to the single line and configured to extract steam therefrom;

a feedwater heater to heat feedwater to a final feed water temperature fluidly connected to the second end of the steam extraction line, wherein the feedwater heater is downstream of the connection between the single line and the steam extraction line, the feedwater heater including a feedwater heating line therein, wherein the feedwater heating line is in thermal communication with the steam extracted from the steam extraction line;

wherein the steam extraction line delivers an extraction fraction of steam from the turbine to the feedwater heater; and a steam generator in circuitous fluid connection with the feedwater heating line, wherein the final feedwater temperature is a temperature of the feedwater upon exiting the feedwater heater and upon entering the steam generator, and wherein the final feedwater temperature is varied based on the extraction fraction of steam.

2. The structure of claim 1, further comprising a control system for opening and closing each of the plurality of steam extraction ports in response to a change in a load at which the turbine operates to maintain a desired final feedwater temperature, wherein the desired final feedwater temperature is based on at least one of a fuel type and the load at which the turbine operates.

3. The structure of claim 1, wherein the plurality of feedwater extraction ports further comprises between two and seven feedwater extraction ports.

4. The structure of claim 2, wherein the control system prevents more than one of the plurality of steam extraction ports from being open at a time.

5. The structure of claim 2, wherein each of the plurality of pipes has a different extraction pressure.

6. The structure of claim 3, wherein the plurality of feedwater extraction ports further comprises four feedwater extraction ports.

7. A system for controlling a power output of a power plant, the system comprising:

a variable feedwater heating system including:

a turbine having a plurality of steam extraction ports;

a plurality of pipes, wherein each pipe has a first end, a valve, and a second end, the first end of each pipe being fluidly connected to a respective plurality of steam extraction ports, wherein the second end of each of the plurality of pipes is connected in parallel to a single line;

a steam extraction line having a first end and a second end, the first end of the steam extraction line being fluidly connected to the single line and configured to extract steam therefrom;

a feedwater heater for heating feedwater to fluidly connected to the second end of the steam extraction line, wherein the feedwater heater is downstream of the connection between the single line and the steam extraction line, the feedwater heater including a feedwater heating line therein, wherein the feedwater heating line is in thermally communication with the steam extracted from the steam extraction line;

wherein the steam extraction line delivers an extraction fraction of steam from the turbine to the feedwater heater for;

a control system including a processor and a memory, the memory having instructions stored thereon which, when executed by the processor, perform the steps of:

opening or closing at least one valve of the plurality of valved steam extraction ports in response to a desired final feedwater temperature, wherein executing an instruction to open or close a valve of the plurality of valved steam extraction ports changes the extraction fraction of steam, and a change in the extraction fraction of steam changes the desired final feedwater temperature; and a steam generator in circuitous fluid connection with the feedwater heating line, wherein the desired final feedwater temperature is a temperature of the feedwater upon exiting the feedwater heater upon entering the steam generator, and wherein the final feedwater temperature is varied based on the extraction fraction of steam.

8. The system of claim 7, wherein the desired final feedwater temperature is based on at least one of a fuel type and a load at which the turbine operates.

9. The system of claim 7, wherein the steam generator further comprises one or more of: a multi-fuel boiler, a biomass fueled boiler, a fossil fueled boiler, an oxygen combustion boiler, and an air combustion boiler.

10. The system of claim 7, wherein the steam generator further comprises one of: a nuclear reactor, a geothermal energy source, and a solar energy source.

11. The system of claim 7, wherein the extraction fraction is adjusted in accordance with a fuel type used in the steam generator in order to vary the desired final feedwater temperature in accordance with the fuel type used in the steam generator.

12. The system of claim 7, wherein at most one of the plurality of valves may be open at a time.

13. The system of claim 7, wherein the plurality of feedwater extraction ports further comprises between two and seven feedwater extraction ports.

14. The system of claim 7, wherein the desired final feedwater temperature further comprises a final feedwater temperature at which a flue gas exhausted from the steam generator remains in a gaseous state and does not condense on a pipe.

15. The system of claim 7, wherein the turbine is operating at a partial load, and the desired final feedwater temperature is determined according to an equation:

$$\mathrm{FFWT}=T_{sat}(P)$$

where

FFWT=the desired final feedwater temperature;

Tsat=a saturation temperature of steam at an extraction port pressure; and

P=the extraction port pressure in the feedwater heater and of the extraction fraction.

16. The system of claim 8, wherein each of the plurality of pipes has a different extraction pressure.

17. The system of claim 13, wherein the plurality of feedwater extraction ports further comprises four feedwater extraction ports.

18. A method for optimizing a final feedwater temperature comprising:

providing a variable feedwater heating system including:

a turbine having a plurality of valved steam extraction ports;

a plurality of pipes, wherein each pipe has a first end, a valve, and a second end, the first end of each pipe being fluidly connected to a plurality of steam extraction ports, wherein the second end of each of the plurality of pipes is connected in parallel to a single line;

extracting steam from a steam extraction line having a first end and a second end, the first end of the steam extraction line being fluidly connected to the single line;

heating feed water in a feedwater heater fluidly connected to the second end of the steam extraction line, wherein the feedwater heater is downstream of the connection between the single line and the steam extraction line, and the feedwater heater including a feedwater heating line therein, wherein the feed water heating line is in thermal communication with the steam extracted from the steam extraction line;

delivering via the steam extraction line an extraction fraction of steam from the turbine to the feedwater heater; and generating steam using a steam generator positioned in circuitous fluid connection with the feedwater heating line;

actively controlling an extraction fraction of steam from the turbine by opening and closing a valve in the plurality of valved steam extraction ports in response to a desired final feedwater temperature, wherein opening and closing a valve changes the extraction fraction of steam, and a change in the extraction fraction of steam changes the desired final feedwater temperature; and delivering the extraction fraction of steam from the turbine to the feedwater heater through the steam extraction line, wherein the desired final feedwater temperature is a temperature of the feedwater upon exiting the feedwater heater and upon entering the steam generator, and wherein the desired final feedwater temperature is varied based on the extraction fraction of steam.

19. The method of claim 18, further comprising:

operating the turbine at a partial load; and determining the desired final feedwater temperature according to an equation:

$$\mathrm{FFWT}=T_{sat}(P)$$

in which:

FFWT=the desired final feedwater temperature;

Tsat=a saturation temperature of steam at an extraction port pressure; and

P=the extraction port pressure in the feedwater heater and of the extraction fraction.

* * * * *